US009293833B2

(12) United States Patent
Jawed et al.

(10) Patent No.: US 9,293,833 B2
(45) Date of Patent: Mar. 22, 2016

(54) LOW IMPEDANCE SLOT FED ANTENNA

(75) Inventors: Shaikh Farooq Jawed, Aalborg (DK); Simon Svendsen, Aalborg (DK); Ole Jagielski, Frederikshavn (DK); Pevand Bahramzy, Taastrup (DK)

(73) Assignee: Molex, LLC, Lisle, IL (US)

( * ) Notice: Subject to any disclaimer, the term of this patent is extended or adjusted under 35 U.S.C. 154(b) by 100 days.

(21) Appl. No.: 13/878,666

(22) PCT Filed: Oct. 12, 2011

(86) PCT No.: PCT/US2011/055869

§ 371 (c)(1),
(2), (4) Date: Apr. 10, 2013

(87) PCT Pub. No.: WO2012/051233

PCT Pub. Date: Apr. 19, 2012

(65) Prior Publication Data

US 2013/0207862 A1 Aug. 15, 2013

Related U.S. Application Data

(60) Provisional application No. 61/392,187, filed on Oct. 12, 2010.

(51) Int. Cl.

| | |
|---|---|
| ***H01Q 13/10*** | (2006.01) |
| ***H01Q 1/24*** | (2006.01) |
| ***H01Q 9/42*** | (2006.01) |

(52) U.S. Cl.

CPC ..... *H01Q 13/106* (2013.01); *H01Q 1/243* (2013.01); *H01Q 9/42* (2013.01); *H01Q 13/10* (2013.01)

(58) Field of Classification Search

CPC ..... H01Q 1/38; H01Q 1/50
USPC ..... 343/757, 700 MS, 702, 860
See application file for complete search history.

(56) References Cited

U.S. PATENT DOCUMENTS

| | | | | |
|---|---|---|---|---|
| 6,133,878 | A * | 10/2000 | Lee | 343/700 MS |
| 6,873,291 | B2 | 3/2005 | Aoyama et al. | |
| 7,629,929 | B2 * | 12/2009 | Son et al. | 343/700 MS |
| 8,654,012 | B2 * | 2/2014 | Kim et al. | 343/700 MS |
| 8,870,077 | B2 * | 10/2014 | Kato | 235/492 |
| 2003/0098812 | A1 | 5/2003 | Ying et al. | |
| 2007/0080867 | A1 | 4/2007 | Son et al. | |
| 2008/0001837 | A1 | 1/2008 | Liu | |
| 2008/0309578 | A1 | 12/2008 | Son et al. | |
| 2009/0140928 | A1 * | 6/2009 | Choi et al. | 343/700 MS |
| 2009/0174604 | A1 | 7/2009 | Keskitalo et al. | |

FOREIGN PATENT DOCUMENTS

| | | | |
|---|---|---|---|
| KR | 2010-0095910 | A | 9/2010 |
| WO | WO 2011/031668 | A1 | 3/2011 |

OTHER PUBLICATIONS

International Search Report for PCT/US2011/055869.

* cited by examiner

*Primary Examiner* — Huedung Mancuso
(74) *Attorney, Agent, or Firm* — Stephen L. Sheldon

(57) ABSTRACT

A low impedance slot fed antenna with a slot and an element configured to resonate is depicted. The orientation of the slot is configured so that a slot current is not opposed to a return current associated with the element. This helps decrease coupling between the slot and the element, which can benefit high Q antennas.

6 Claims, 14 Drawing Sheets

LOW IMPEDANCE SLOT FED ANTENNA

RELATED APPLICATIONS

This application is a national phase of PCT Application No. PCT/US2011/055869, filed Oct. 12, 2011, which in turn claims priority to U.S. Provisional Application No. 61/392,187, filed Oct. 12, 2010, which is incorporated herein by reference in its entirety.

FIELD OF THE INVENTION

The present invention relates to the field of antennas, more specifically to the field of antenna that are suitable for use in portable devices.

DESCRIPTION OF RELATED ART

The use of a Low Impedance Slot Feed (LISF) on a high Q antenna element has been found to provide certain benefits. For example, co-owned (and with common inventors) PCT Application No. PCT/US10/47978, filed Sep. 7, 2010, the contents of which are incorporated herein by reference in their entirety, discloses a LISF antenna.

A conventional LISF antenna has the slot orientated as shown in FIG. 1, with the feed positioned between the short of the slot and the short of the element. Specifically, an antenna system 25 is configured to work with a transceiver 25 provided on a circuit board 15 that includes a ground plane 20 so as to provide a communication system 10. An element 50 (which is configured to resonant at desired frequencies) includes a body 56 and an arm 58 that is shorted to the ground plane 20 while a slot 35 is coupled to a feed 35 on one end and shorted to the ground plane on a second end. Thus, in operation, a current loop forms around the slot and coupling between the slot and the element creates a corresponding current on the element. As can be appreciated, the depicted configuration creates a relative strong coupling between the slot 35 and to the element 50 and results in a high voltage across the feed 30. The resultant performance of the antenna system can be appreciated from FIG. 2A, which includes a plot 80.

The coupling to the element 50 can be reduced by either moving the slot 35 away from the short of the element or by increasing the distance between the element and the slot, the results of both such adjustments being shown in plots 81 and 82 of FIG. 2B. For example, in FIG. 2B the plot 81 the feed was moved 5 mm further away from the short between the element and the ground plane while plot 82 moved the slot 1 mm closer to the ground plane and the distance between the slot and element was increased by 0.5 mm. It can be appreciated from FIGS. 2A and 2B that the size of the resonance (Voltage across the feed) can be controlled by the position of the feed and the distance between the slot and the element. However, if the Q of the antenna element is sufficiently high and the impedance bandwidth requirement is low, it might not be possible to optimize the size of the resonance to only cover the desired frequency span (e.g., to provide an optimum match), since the coupling is too strong. Thus, further improvements would be appreciated by certain individuals.

BRIEF SUMMARY

A low impedance slot fed antenna with a slot and an element configured to resonate is depicted. The orientation of the slot is configured so that a first path taken by a slot current is not opposed to a second path taken by a return current associated with the element. This helps decrease coupling between the slot and the element, which can benefit high Q antennas. In an embodiment, the slot is provided by a separate component. In another embodiment, the slot is provided in a ground plane of a circuit board.

BRIEF DESCRIPTION OF THE DRAWINGS

The present invention is illustrated by way of example and not limited in the accompanying figures in which like reference numerals indicate similar elements and in which.

DETAILED DESCRIPTION

The detailed description that follows describes exemplary embodiments and is not intended to be limited to the expressly disclosed combination(s). Therefore, unless otherwise noted, features disclosed herein may be combined together to form additional combinations that were not otherwise shown for purposes of brevity.

Figure 1:
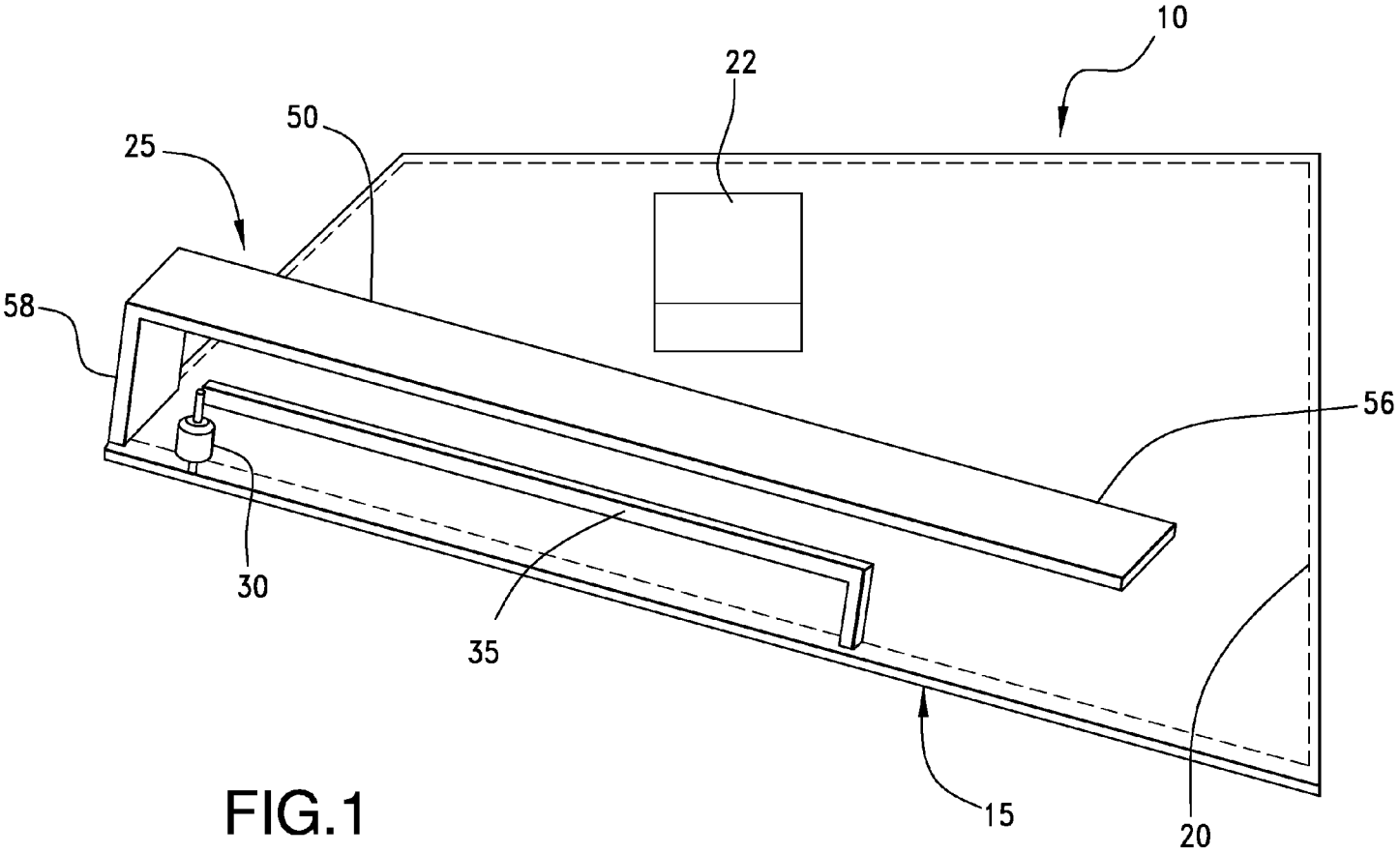
FIG. 1 illustrates an embodiment of a Low Impedance Slot Feed (LISF) antenna configured to have a slot current oppose a return current.
Figure 2A:
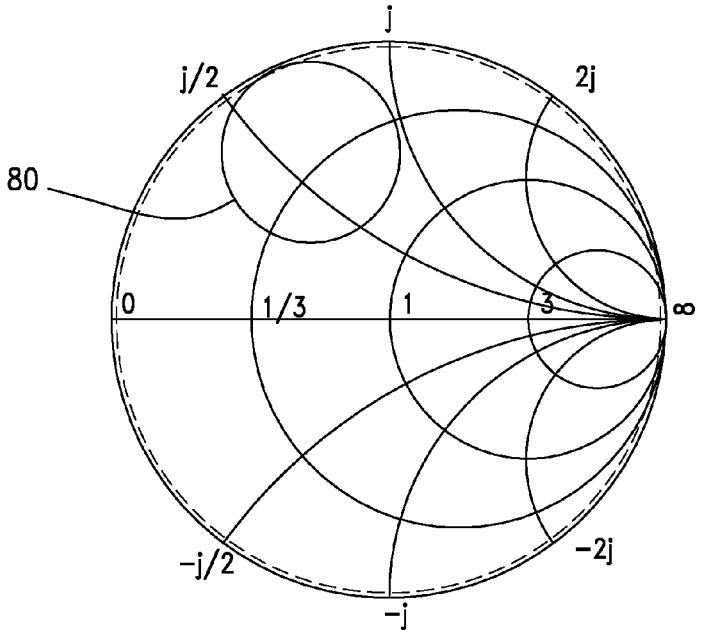
FIG. 2A illustrates non-matched impedance of the antenna depicted in FIG. 1.
Figure 2B:
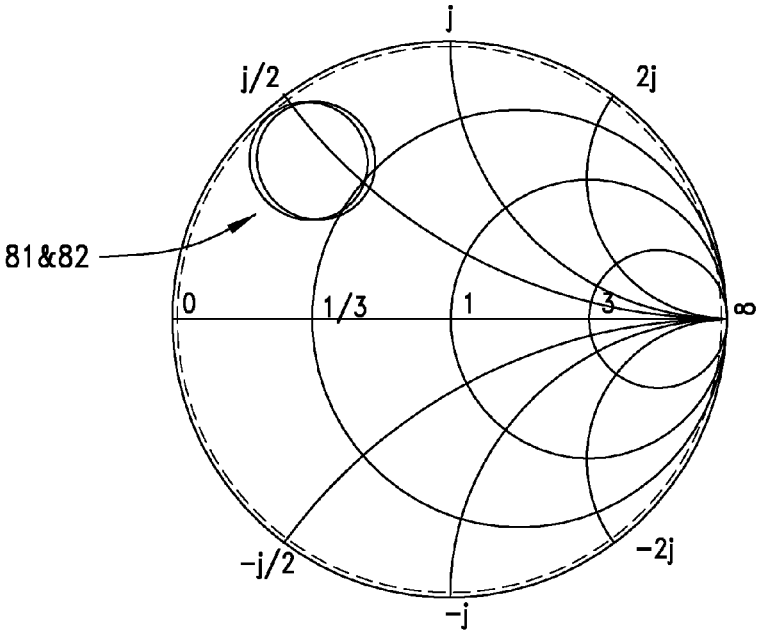
FIG. 2B illustrates non-matched impedance of the antenna depicted in FIG. 1 with two different adjustments made to the slot position.
Figure 3:
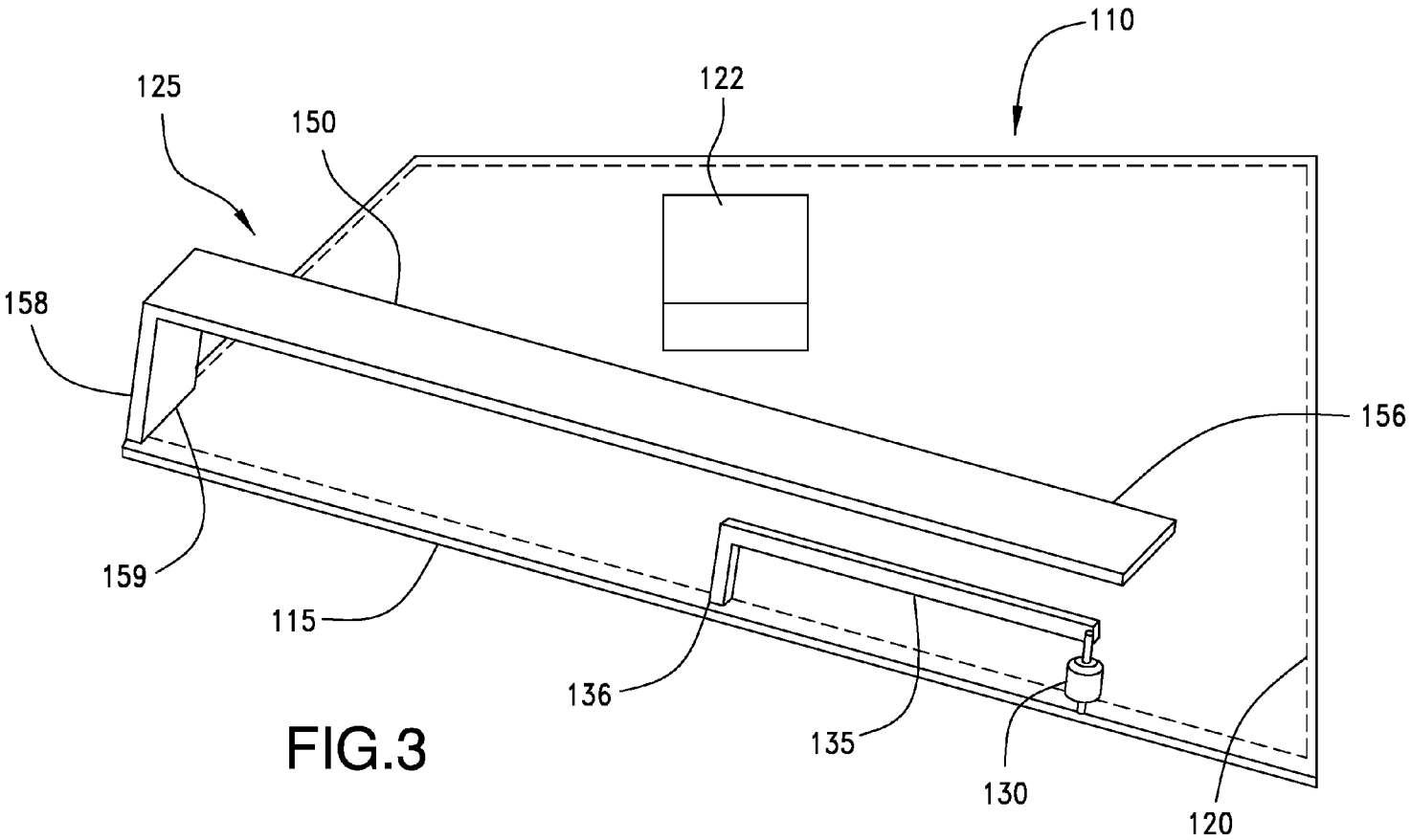
FIG. 3 illustrates an embodiment of an Inverted Low Impedance Slot Feed (ILISF) antenna that includes an element and a slot.
Figure 3A:
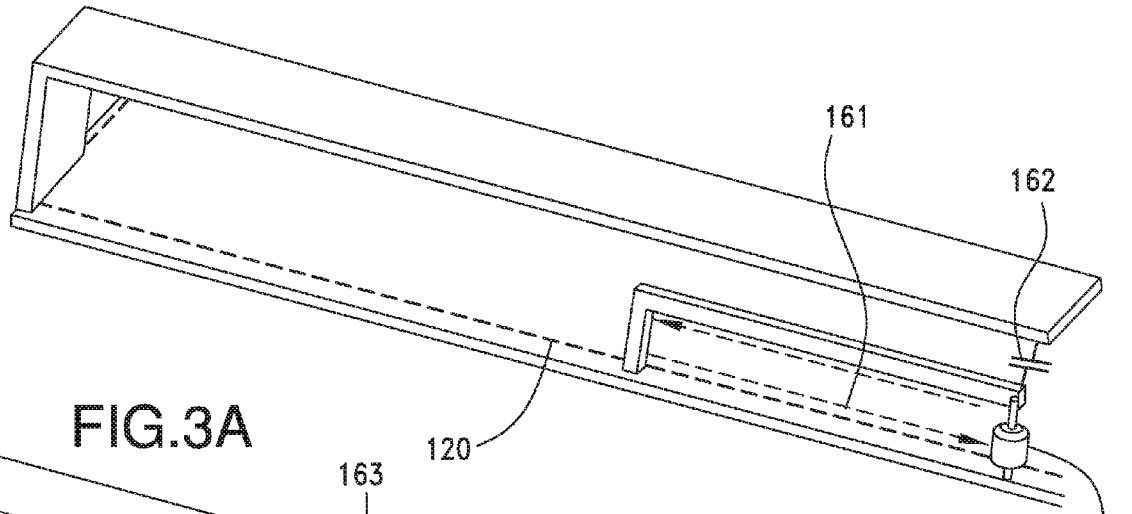
FIG. 3A illustrates a path taken by slot current associated with the slot depicted in FIG. 3.
Figure 3B:
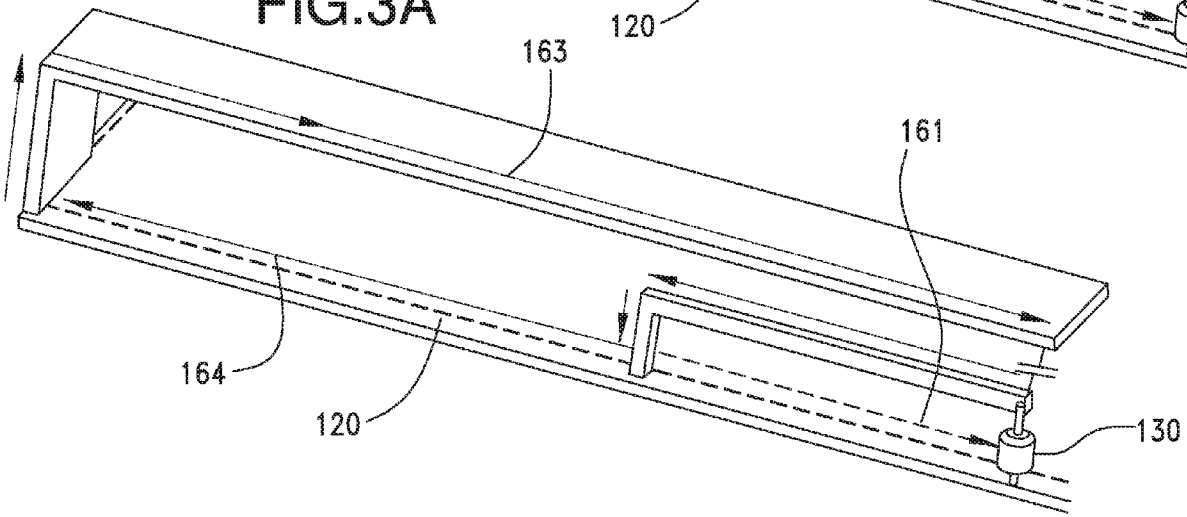
FIG. 3B illustrates a path taken resonant and return current associated with the element depicted in FIG. 3.

As can be appreciated, it has been determined that it would be beneficial to reduce the coupling between the slot and the high Q antenna element. This reduction allows for better handling of the strong E-fields and H-field generated by a high Q antenna element. It has been determined that the strength of the coupling increases the closer the feed is to the short of the element, as this is where the strongest currents are running. While moving the feed away from the short in the element helps, it is difficult to move it far enough, particularly if a small package is desired. However, it has been determined that the coupling can be reduced by inverting the position of the slot, as depicted in an embodiment illustrated in FIG. 3. This configuration can be referred to as an Inverted Low Impedance Slot Fed (ILISF) antenna.

As depicted, a communication system includes a transceiver 122 mounted on a circuit board 115 that includes a ground plane 120. As is known, a ground plane can include a number of layers and may be coupled together with vias or the like, however a simplified version is depicted for ease of depiction. The transceiver 125 can include a transmission line (not shown) that is coupled to the feed 130, which is coupled to an end of slot 135. The slot 135 has a short 136 to ground that allows the current to flow back toward feed 130 (creating a current loop) and providing a slot current 161, or $I_{slot}$. The voltage difference between the slot and an element 50 causes a capacitive coupling 162 between the slot 135 and body 156 of resonating element 150. The capacitive coupling 162 generates a resonate current 163, $I_{resonant}$, that travels up arm 156, along the body 158 of element 150 and a return current 164, $I_{return}$ travels along the slot and the along the ground plane toward the element short 159.

Figure 4A:
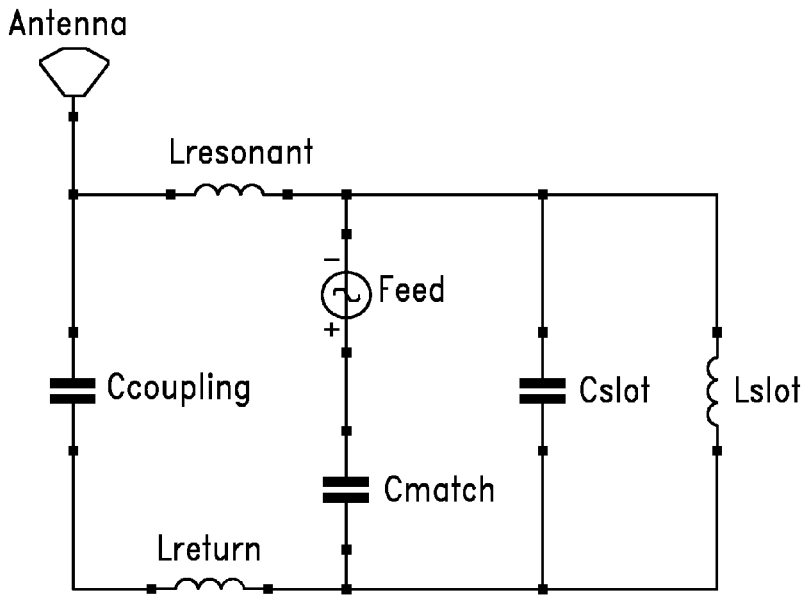
FIG. 4A illustrates a schematic representation of an antenna system similar to that depicted in FIG. 1.

Compared to a LISF antenna, the ILISF antenna can provide reduced coupling between the slot 135 and the feed 130. Reduced coupling is achieved both by having the feed in the low h-field region of the element, and by inverting the slot so that the return current 164 is not applied directly across the feed. The electrical difference between the 2 concepts is best illustrated by looking at the equivalent schematics, shown in FIG. 4.

Figure 4B:
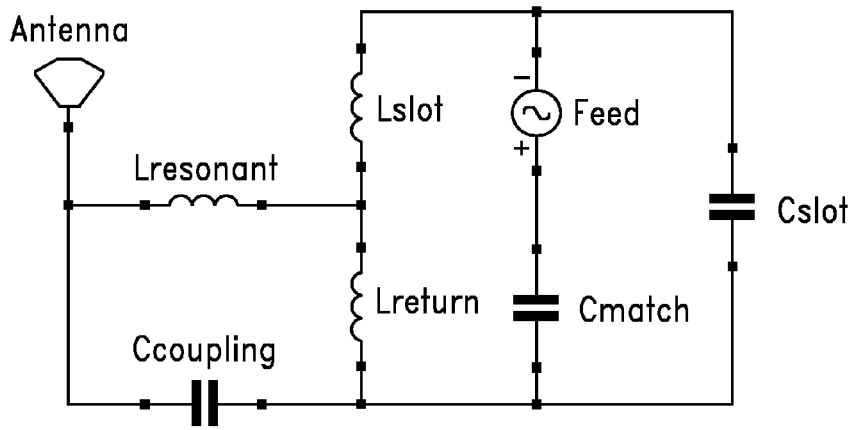
FIG. 4B illustrates a schematic representation of an antenna system similar to that depicted in FIG. 3.

The element is represented by the Antenna, $L_{resonant}$, $C_{coupling}$ and $L_{return}$, the slot by $C_{slot}$ and $L_{slot}$, the feed by a voltage generator and the match is in this example shown as $C_{match}$. It is seen from FIG. 4A, which is a schematic representation of LISF, that the feed is coupled directly across the Antenna in parallel with the slot, resulting in a strong coupling, which will increase with increased $L_{return}$. The ISILF antenna, shown schematically in FIG. 4*b*, is not coupled directly across the feed, but across a series combination of $L_{slot}$ and the feed, reducing the voltage across the feed.

Figure 5A:
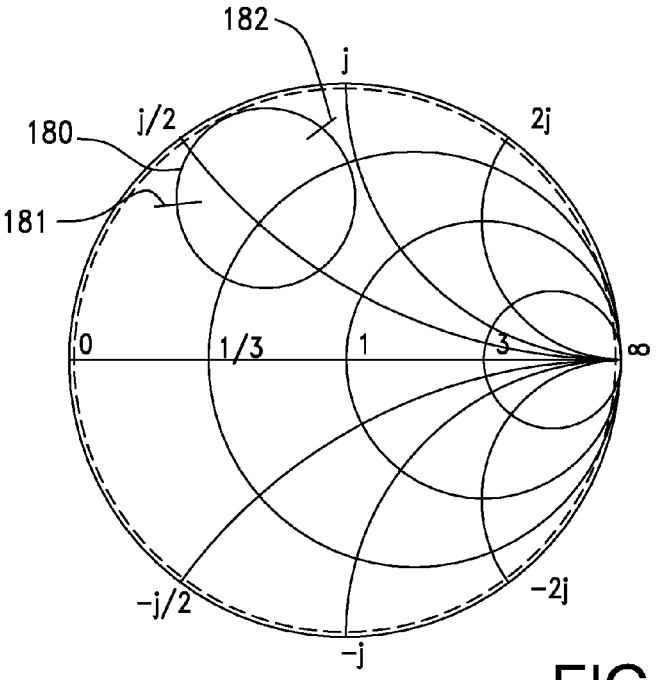
FIG. 5A illustrates an impedance plot of an embodiment of an antenna configured similar to the antenna depicted in FIG. 1.
Figure 5B:
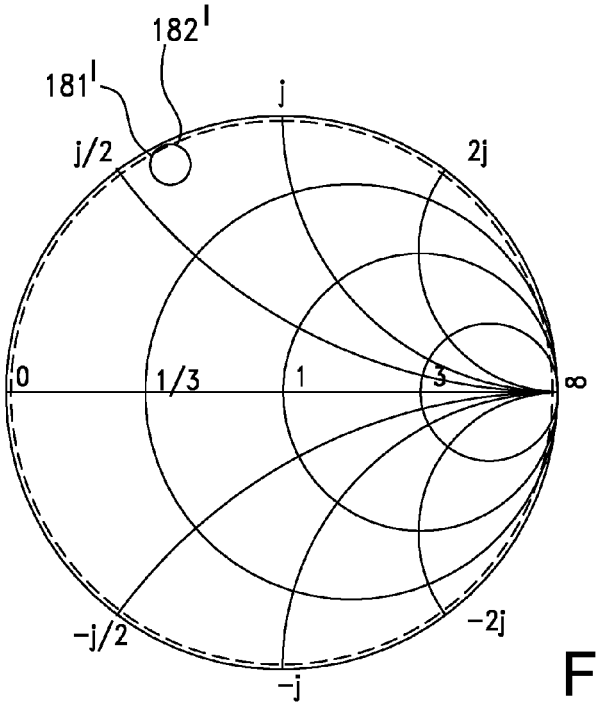
FIG. 5B illustrates an impedance plot of antenna with the same physical dimensions as the antenna used in FIG. 5A but with a short and feed positioned as depicted in FIG. 3.

The benefits of such a system are depicted in FIGS. 5*a* and 5B, where the impedances of a non-matched LISF (FIG. 5*a*) is compared to the impedance of a non-matched ILISF (FIG. 5*b*), using the same dimensions of the element and the slot and only exchanging the position of the feed and the short of the slot. The position and location of the slot can vary more or less as described for the standard LISF concept in Application No. PCT/US10/47978. If the slot is a part of the antenna structure, as in the above examples, then is can be moved along the edge of the circuit board and also perpendicular to the edge of the circuit board, as shown in FIGS. 6A-6D.

Figure 6A:
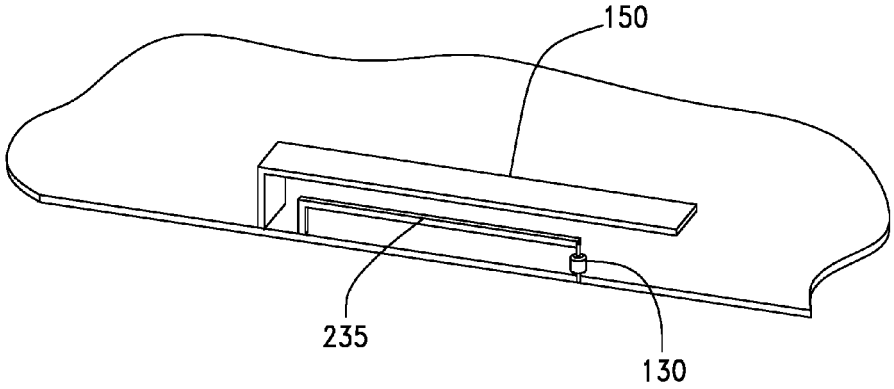
FIG. 6A illustrates an embodiment of an antenna configuration with a first slot orientation.
Figure 6B:
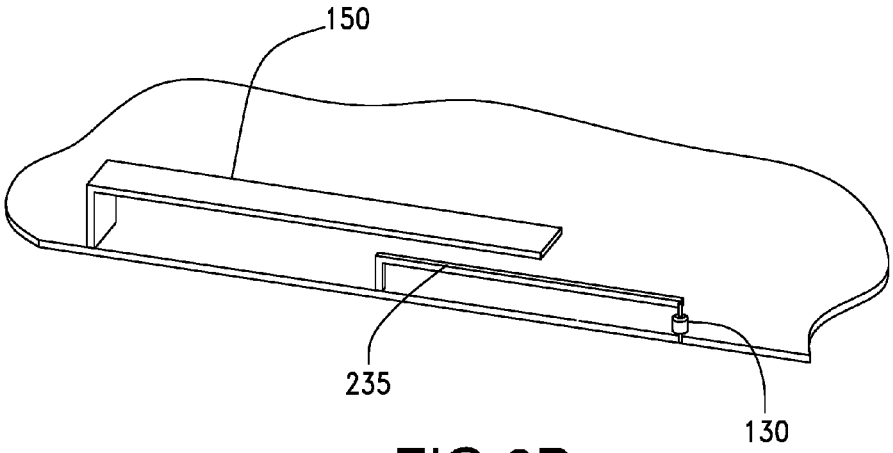
FIG. 6B illustrates an embodiment of an antenna configuration with a second slot orientation.
Figure 6C:
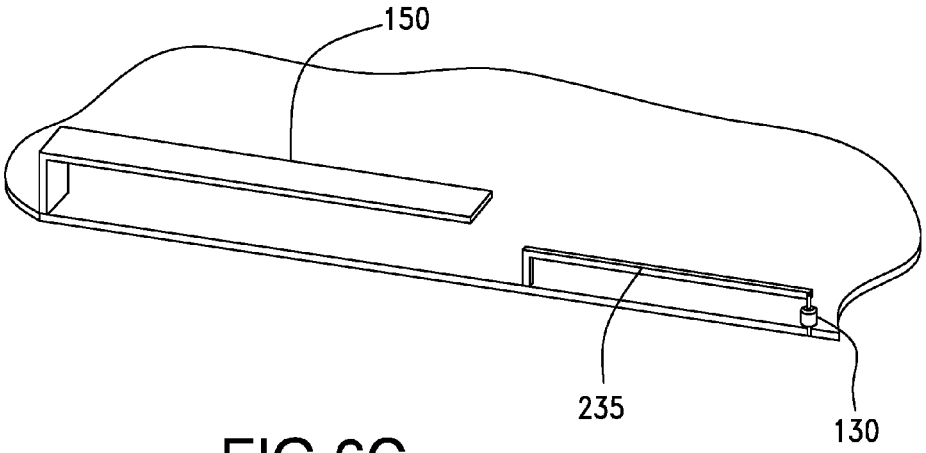
FIG. 6C illustrates an embodiment of an antenna configuration with a third slot orientation.
Figure 6D:
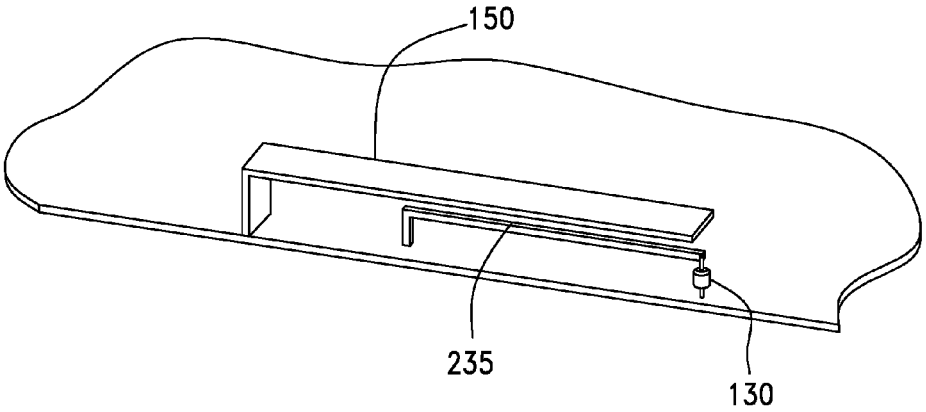
FIG. 6D illustrates an embodiment of an antenna configuration with a fourth slot orientation.

For example, FIG. 6A illustrates a slot 235 with a feed 130 and a short between the slot and the ground being relatively close to a short between an element 150 and the ground. In contrast, FIG. 6B illustrates a slot 235 with a short between the slot and the ground being relatively farther from the short between the element 150 and the ground. FIG. 6C illustrates the slot 235 being position away from the element 150 such that a first short between the slot and the ground is even farther away from a second short between the body and the ground plane. And FIG. 6D illustrates an embodiment where the slot is not positioned along an edge of the circuit board but instead is positioned inboard of the edge of the circuit board. Thus, substantial flexibility in the location is possible and while it is often beneficial to have a slot adjacent an edge of a circuit board, such a design is not required. Such a change, as can be appreciated, is expected to affect the coupling and the impedance of the antenna.

Figure 7A:
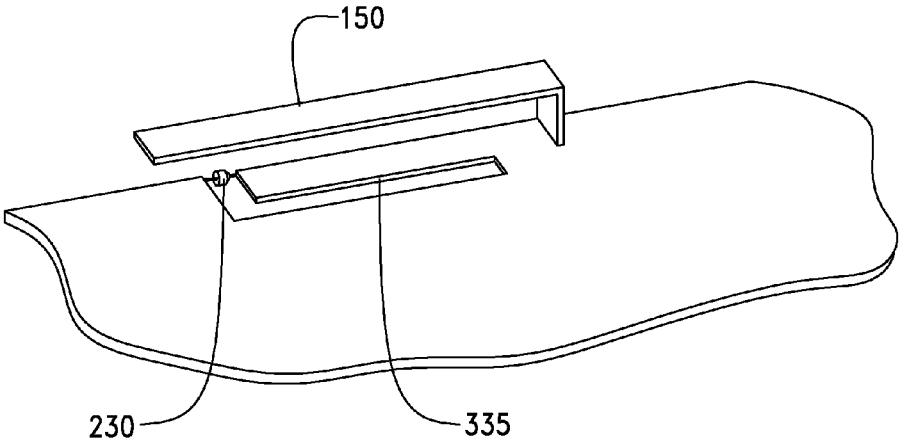
FIG. 7A illustrates an embodiment of an antenna configuration with a first slot orientation, the slot provided in a ground plane.
Figure 7B:
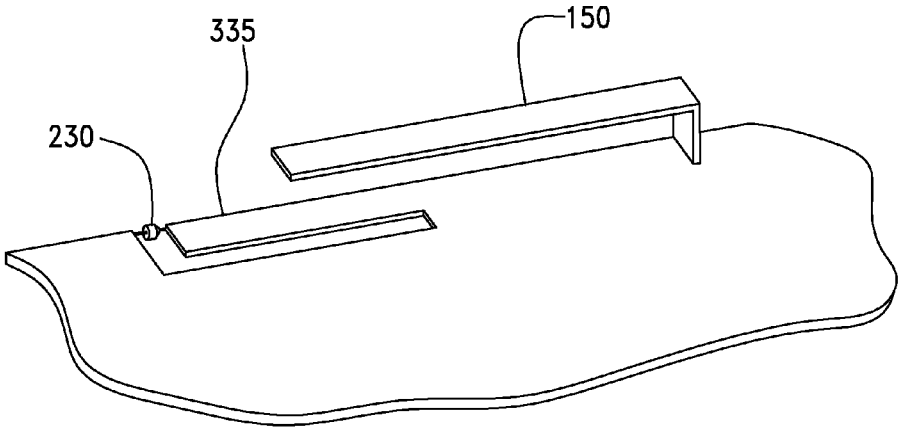
FIG. 7B illustrates an embodiment of an antenna configuration with a second slot orientation, the slot provided in a ground plane.
Figure 7C:
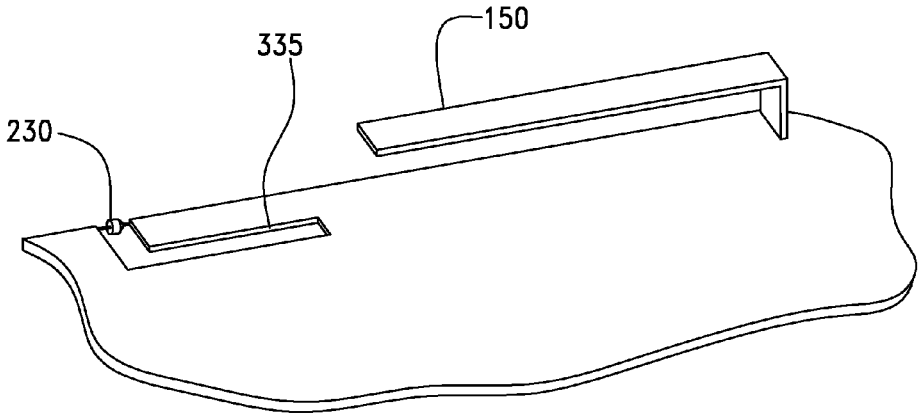
FIG. 7C illustrates an embodiment of an antenna configuration with a third slot orientation, the slot provided in a ground plane.
Figure 7D:
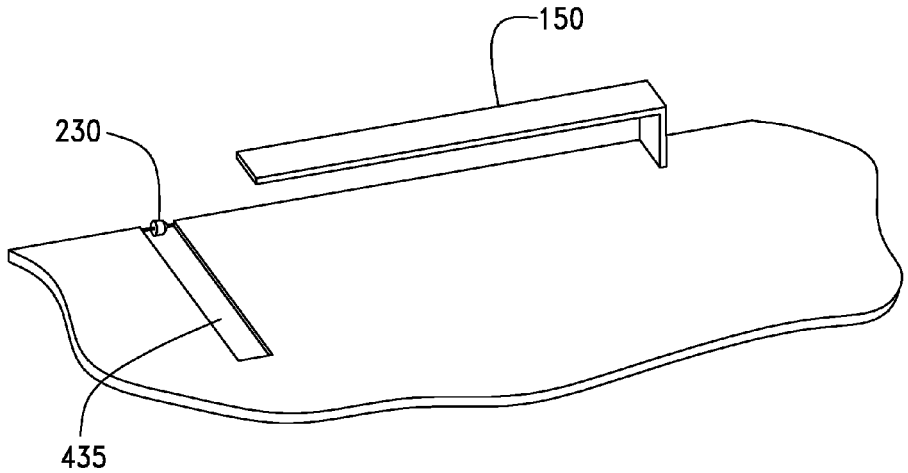
FIG. 7D illustrates an embodiment of an antenna configuration with a fourth slot orientation, the slot provided in a ground plane.

The slot in the ground plane can also be implemented in the circuit board with different shapes and position relative to the element, as shown in FIGS. 7A-7D. The element still has a first short to ground and is shown unsupported, it being understood that in practice it is expected that the element will be supported by an insulative material. In these embodiments, the slot has an open end that is coupled to a feed and a closed end that defines the end of the slot. The closed end can be between the feed and the first short. For example, FIG. 7A illustrates a feed 230 with a slot 235 formed in a ground plane and the closed end of the slot is relatively close to a short between an element 150 and the ground plane. In contrast, FIG. 7B illustrates a feed 230 and a slot 235 formed in a ground plane with a closed end of the slot being relatively farther from the short between an element 150 and the ground plane. FIG. 7C illustrates an antenna system with a feed 230 and with a slot 335 that is non-linear and formed in a ground plane such that the closed end of the slot is spaced apart from the end of the element 150 and thus provides an even greater distance between the closed end and the short between an element 150 and the ground plane. And FIG. 7D illustrates an embodiment where a slot extends away from an edge (and the element) such that the closed end is not positioned along an edge of the circuit board but instead is positioned inboard of the edge of the circuit board. Thus, substantial flexibility in the location is possible and while it is often beneficial to have a slot adjacent an edge of a circuit board, such a design is not required.

The examples depicted in FIGS. 8-12 are used to illustrate different implementations of the ILISF concept and could be optimized for the ISM band 2.4 GHz (2400 MHz to 2484.5 MHz). As can be appreciated, however, the depicted designs could be used for a different desired frequency by adjusting, for example, the size of the element. Generally speaking, it has been determined to be beneficial to minimize the physical size of edge mounted antennas by using ceramic so as to make it possible to substantially avoid any requirements for a cutback in the circuit board (e.g., to provide a fully on-ground antenna). The ability to avoid the use of a cutback provides additional flexibility in the design of the circuit board but is not required. In an embodiment, for example, the size of the circuit board can be about 40 mm by 100 mm and the antennas can be mounted on the edge of the short side, potentially in the middle of the edge. However, as can be appreciated, any suitably sized circuit board could be used and the antenna need not be mounted in the depicted position.

Figure 8:
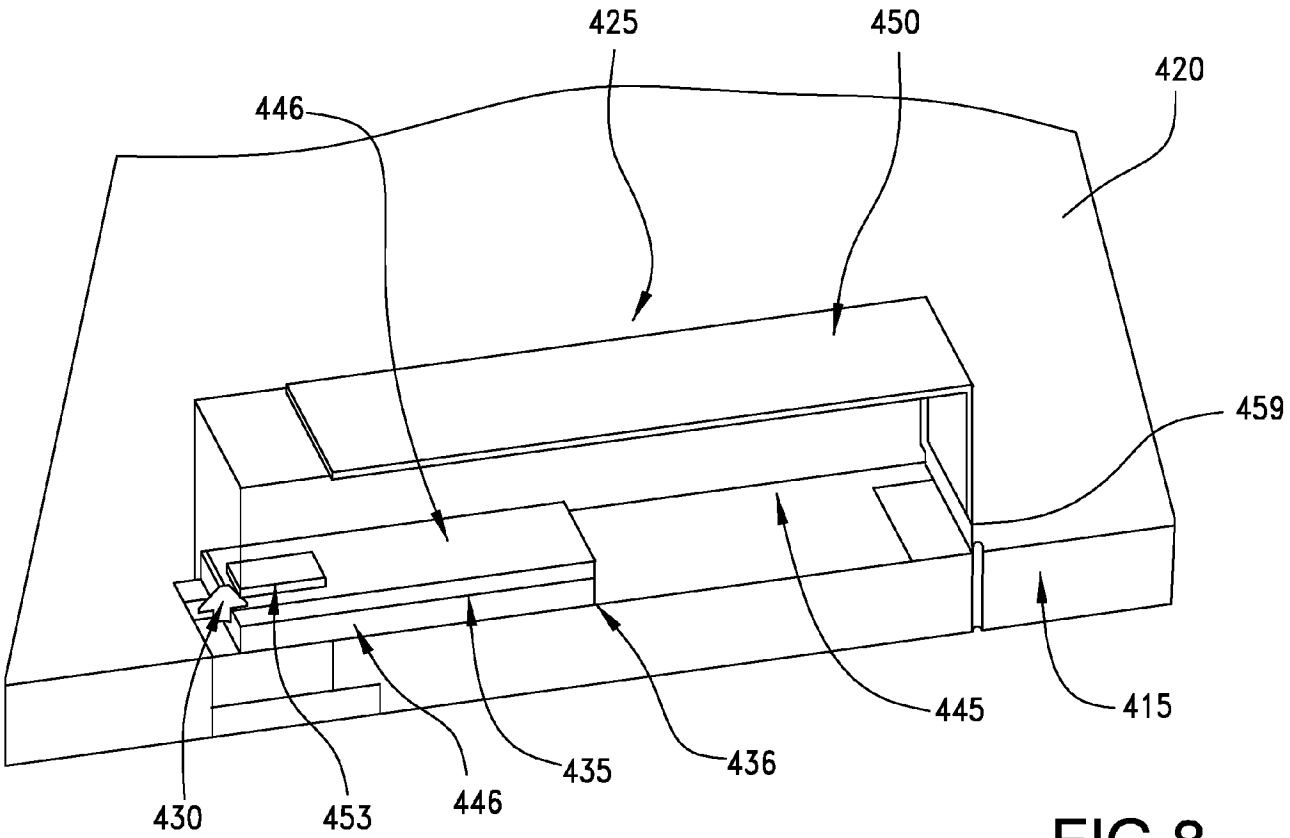
FIG. 8 illustrates an embodiment of an ILISF antenna that includes an element and a slot supported by a block.

FIG. 8, for example, depicts a circuit board 415 that has a ground plane 420 (depicted as covering the entire top surface). As is known, a ground plane can be provided in a circuit board in a variety of manners, and can be covered by an insulative layer, and thus the depicted configuration is simplified for ease of understanding and is not intended to be limiting. An antenna system 425 is provided on the circuit board and includes a feed 430 that is coupled to slot 435. The slot 435 is supported by a first block 446, which can have a relatively high dielectric constant (for example, above 100) and can be formed of a ceramic material and slot 435 has a short 436 that couples the slot 435 to the ground plane 420. Thus, similar to the slot 135 depicted in FIG. 3, the slot 435 is L-shaped and has a first and second end, the second end being coupled to the ground plane and the first end coupled to the feed. In operation, the current from the feed travels along the slot 435 to the short 436 and then the return current travels along the ground plane and passes through match capacitor 453 back to the feed. A second block 445, which can formed of a different material than the first block 446, can have a lower permittivity (e.g., below 40 F/m) and supports an element 450, which has a short 459 to the ground plane 420. In an embodiment, for example, the volume of such an antenna can be 0.032 $cm^3$ (2 mm W×8 mm L×2 mm H). This element 450 functions similarly to how the element 150 functions and thus this explanation will not be repeated for the sake of brevity.

It should be noted that while the depicted structure is ceramic, is not necessary to implement the structure in ceramic as any insulative material could be used. The benefit of using ceramic is that such a material is well suited for use with high Q antenna structures, due to the high dielectric constant and low loss tangent of ceramic.

If a ceramic material is used, the ability to provide a high permittivity $\in_r$ (e.g., $\in_r$=110 F/m) in a configuration as disclosed allows for a reduction in the physical length of the slot, while maintaining the electrical length (position of the resonance in the smith chart). A short physical length of the slot will further reduce the coupling to the element.

Figure 9:
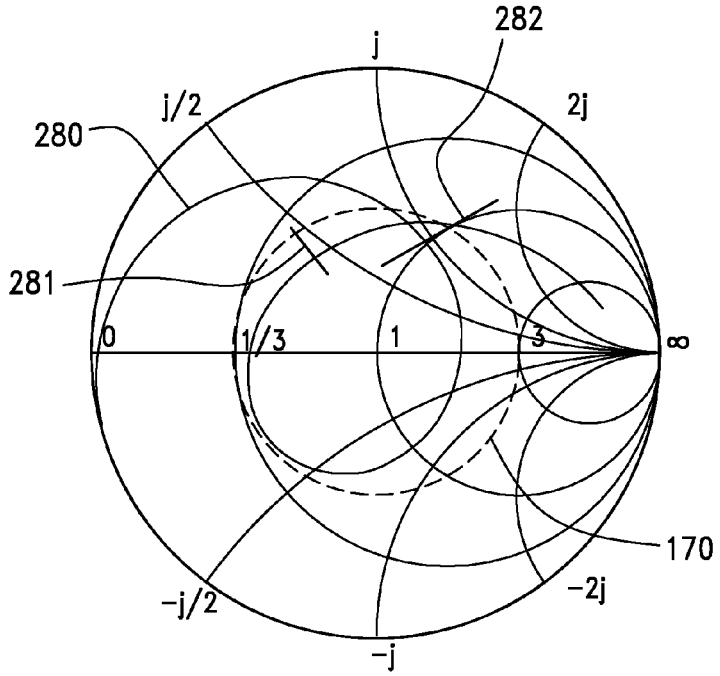
FIG. 9 illustrates an impedance plot of the antenna depicted in FIG. 8.

Typical on ground ceramic WIFI antennas found on the marked today have sizes in the region of 3.2 mm*10 mm*4 mm (W*L*H) (or about 0.128 $cm^3$), and it can be appreciated that typical on-ground ceramic WIFI antennas are larger than an embodiment such as is disclosed above. These antenna types are typically single resonance and require more volume to cover the same impedance bandwidth. In contrast, the depicted embodiment can provide suitable performance with substantially less volume. This reduction in volume and/or the possibility to have a ground plane under the ceramic is possible due to the extra resonance created by the ILISF match. The complex impedance of this antenna is shown in FIG. 9 and, as can be appreciated, includes the extra resonance.

The simulated efficiency for this antenna configuration is around 90%. It is expected, however, that in practice the efficiency will probably be reduce to 80% when implemented as a physical model, in large part due to the soldering of the ceramic component.

Figure 10:
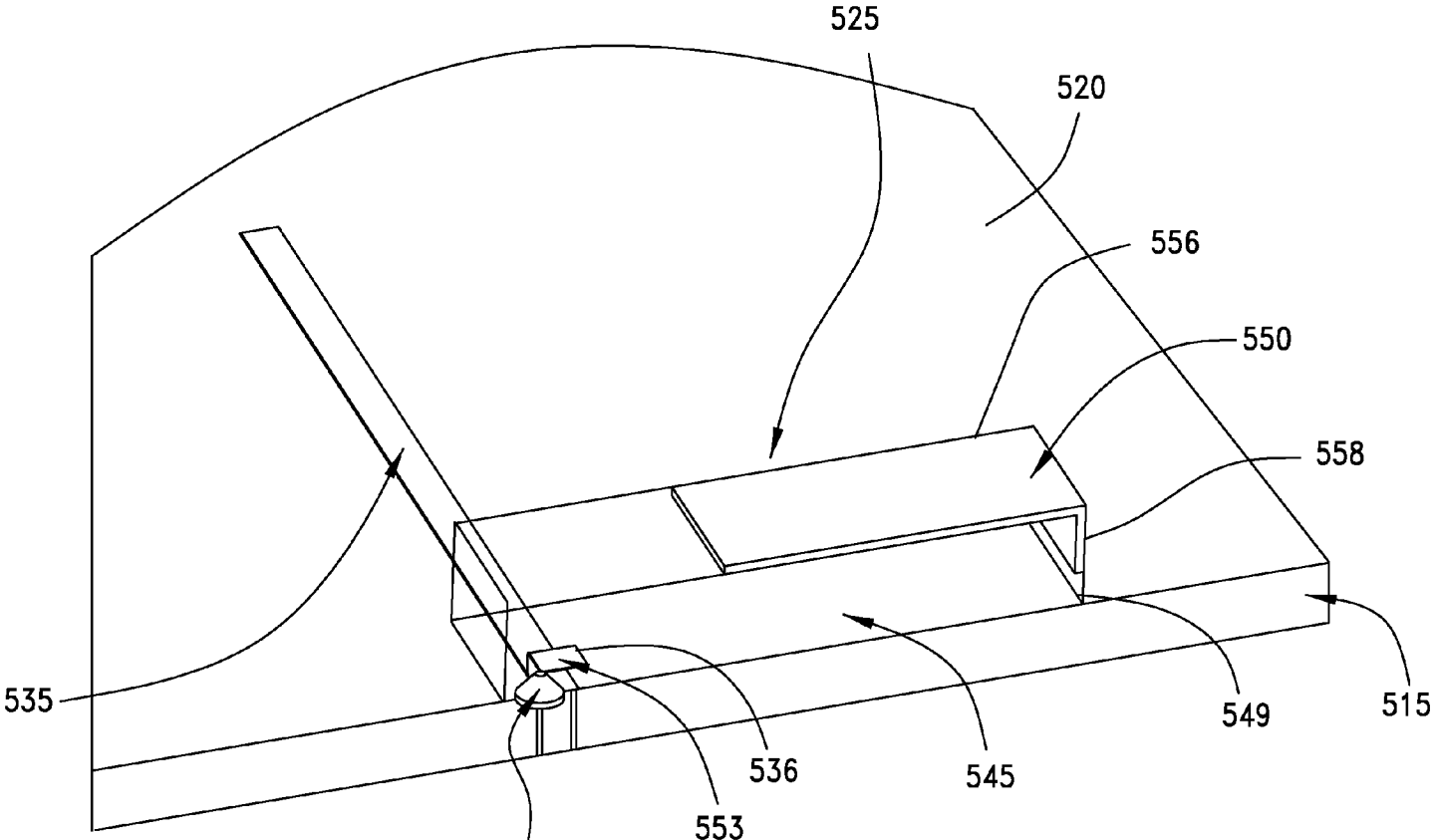
FIG. 10 illustrates an embodiment of an ILISF antenna that includes an element supported by a block and a slot in a ground plane.

In another embodiment, an ILISF antenna system can be provided where the element feed and the matching capacitor are included in the ceramic and the slot is implemented in the support circuit board. FIG. 10 illustrates an embodiment of an antenna system 525 so configured. A circuit board 515 includes a ground plane 520 that supports the antenna system 525. The antenna system includes a ceramic body 545 and supports an element 550 with a body 556 and an arm 558 that has a short 549 along one side of the ceramic body 545. A feed 530 is provided adjacent an opposite end of the body 545. The feed 530 couples to the ground plane 520 and the return path for current from the ground plane extends around slot 535, returning via a matching circuit, which in an embodiment can be a capacitor. The current loop couples to the element, generating a corresponding current loop in the element. Because of the use of the slot 535 in the ground plane 520, the size of the antenna system 525 can be further reduced, and in an exemplary embodiment the body has a size of 2 mm*8 mm*1.5 mm (W*L*H) or a volume of 0.024 $cm^3$. As can be appreciated, the slot 535 is perpendicular to the edge of the PCB and can be longer than the antenna (e.g., greater than 8 mm long) but can be kept relatively (e.g., with a width of about 0.5 mm). As can be appreciated, however, depending on the frequency and desired sensitivity, the desired size of ILISF antenna system and resultant slot may change. Certain applications, for example, may require slightly larger volume.

Figure 11:
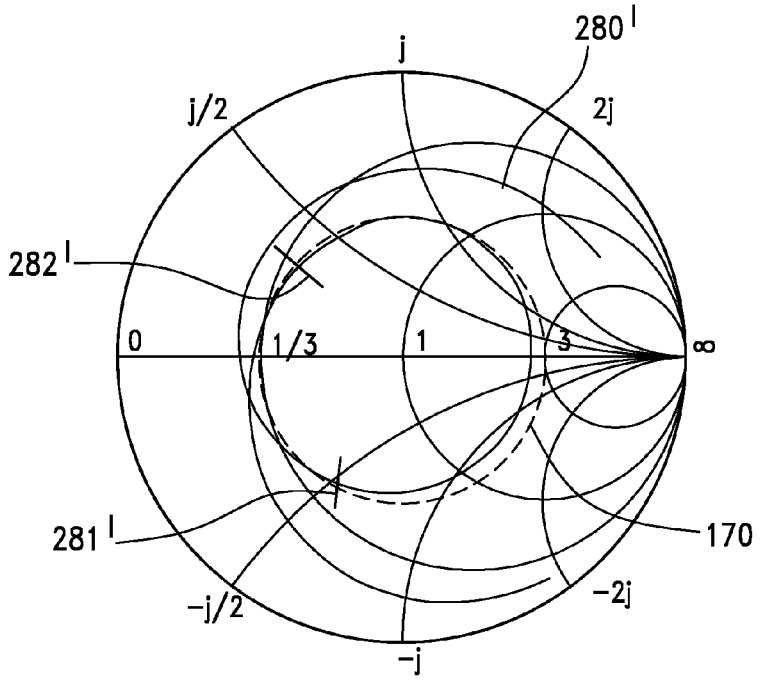
FIG. 11 illustrates an impedance plot of the antenna depicted in FIG. 10.

The complex impedance of the antenna system 525 is shown in FIG. 11. The frequency response is kept within a standing wave ratio (SWR) circle 170 (which has a value of 3) from frequency 282' to 281', which in an example may be about 2400 MHz to 2484.5 MHz.

Figure 12:
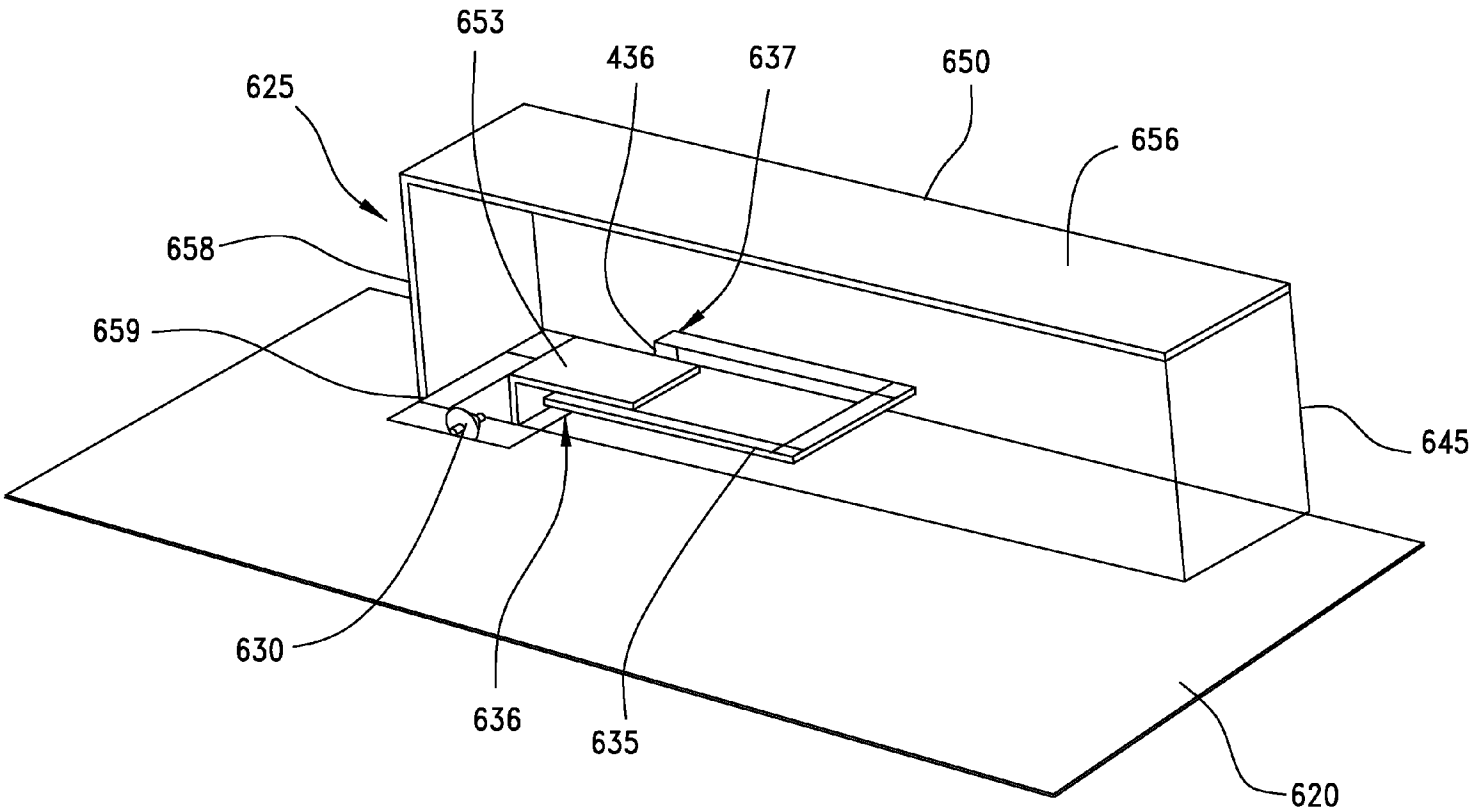
FIG. 12 illustrates an embodiment of an ILISF antenna that includes an element and an U-shaped slot supported by a block.

FIG. 12 illustrates another embodiment of an exemplary antenna system 625. A feed 630 is electrically connected to a slot 635 via a capacitor 653 (which is depicted in series between the feed 630 and the slot 635). The slot 635 is U-shaped with a first end 636 and a second end 637 that has a short 436 that couples to a ground plane 620 (which in practice is typically supported by a circuit board but is not shown for sake of clarity). As can be appreciated, the slot 635 is positioned in a block 645 that is made of a dielectric material (such as a ceramic material) that can have a permittivity of between 10 and 30 and preferably closer to 18-22 F/m. It should be noted, however, that the desired permittivity will depend on a number of external factors (such as Q of the antenna) and therefore the selection of the desired permittivity will vary in certain embodiments. The block 645 supports an element 650 that includes a body 656 and an arm 658 that has a short 659 that couples the element 650 to the ground plane 620.

The current flows are similar to what was discussed above, with a slot current traveling along a first path through the ground plane 620 from the short 436 to the feed 630. As can be appreciated, therefore, the first path taken by the slot current associated with slot 635 is not opposed to a second path taken by a return current associated with a resonant current provided in element 650 (due to coupling between the slot 635 and the element 650).

The disclosure provided herein describes features in terms of preferred and exemplary embodiments thereof. Numerous other embodiments, modifications and variations within the scope and spirit of the appended claims will occur to persons of ordinary skill in the art from a review of this disclosure.

We claim:

1. An antenna system, comprising:

a ground plane;

an element with a body having a first and second end, the element including an arm on a first end of the body, the arm having a first short to the ground plane;

a slot in the ground plane; and a feed configured to generate a slot current around the slot, wherein the slot current is positioned adjacent the element such that a resonate current is generated on the element via capacitive coupling and wherein a return current from the capacitive coupling point to the first short is in the same direction as the slot current.

2. The antenna system of claim 1, wherein the slot is an L-shaped structure with a first end coupled to the feed and positioned above the ground plan and a second end forming a second short to the ground plane.

3. The antenna system of claim 2, wherein the second short is positioned between the feed and the first short.

4. The antenna system of claim 1, wherein the slot has an open end coupled to the feed and a closed end defining the slot.

5. The antenna system of claim 4, wherein the closed end is a first distance from the feed and the first short is a second distance from the feed, the second distance being greater than the first distance.

6. The antenna system of claim 4, wherein the closed end is positioned between the first short and the feed.

* * * * *